United States Patent [19]

Gordon et al.

[11] Patent Number: 4,958,990

[45] Date of Patent: Sep. 25, 1990

[54] MOTOR-COMPRESSOR WITH MEANS TO REDUCE NOISE

[75] Inventors: James F. Gordon; Owen H. Scheldorf, both of Louisville, Ky.; Gary O. Scheldorf, Greenville, Ind.

[73] Assignee: General Electric Company, Louisville, Ky.

[21] Appl. No.: 414,369

[22] Filed: Sep. 29, 1989

[51] Int. Cl.[5] ..... F04B 39/12; F04C 29/00

[52] U.S. Cl. ..... 417/410; 29/888.025; 417/902

[58] Field of Search ..... 417/360, 410, 902; 29/156.4 R

[56] References Cited

U.S. PATENT DOCUMENTS

| | | | |
|---|---|---|---|
| 4,105,374 | 8/1978 | Scharf | 417/415 |
| 4,623,304 | 11/1986 | Chikada et al. | 417/312 |
| 4,744,737 | 5/1988 | Yamamura | 417/902 |

FOREIGN PATENT DOCUMENTS

| | | | |
|---|---|---|---|
| 61-16287 | 1/1986 | Japan | 417/902 |
| 61-38181 | 2/1986 | Japan | 417/902 |
| 62-55492 | 3/1987 | Japan | 417/902 |
| 62-205488 | 8/1988 | Japan | 417/902 |

*Primary Examiner*—Robert G. Nilson

*Attorney, Agent, or Firm*—Radford M. Reams; H. Neil Houser

[57] ABSTRACT

A hermetically sealed compressor unit includes a hermetically sealed casing having a side wall with a cylindrical inner surface; an electric motor is positioned within the casing and includes a stator with a cylindrical outer wall having an interfering fit with the casing side wall inner surface; a rotary compressor unit driven by the motor includes a cylinder spaced from the motor and having a cylindrical outer wall welded to the casing side wall at selected positions; and at least one stiffening ring positioned adjacent the cylinder and having a cylindrical outer wall of a larger diameter than said cylinder outer wall and having an interfering fit with the casing side wall inner surface.

6 Claims, 2 Drawing Sheets

MOTOR-COMPRESSOR WITH MEANS TO REDUCE NOISE

BACKGROUND OF THE INVENTION

Refrigeration compressors emit an unacceptable level of noise. Many attempts have been made to dampen, absorb or otherwise effectively eliminate such emitted noise. None of them have been completely satisfactory for all types of compressors and applications.

In rotary compressors typically the compressor cylinder is physically attached to the side wall of the casing in order to permanently fix the position of the cylinder in the housing. A normal method of attachment is by spot welding the cylinder and casing side wall at selected positions around the circumference of the casing. During operation, the compressor repeatedly compresses charges of refrigerant gas and releases this compressed gas into the casing. The compression and release action sets up vibrations, or noise, in the compressor cylinder which tend to radiate radially outwardly toward the casing side wall.

It is believed that there are two primary paths of noise transmission. One is by the gas itself. The second is via a conduction path from the cylinder through the cylinder casing interface to the casing. It is believed that the principal mode of conduction is the second path. Of course, it is chiefly the vibration of the casing which generates the audible noise heard by consumers.

Typically the casing side wall is in very close proximity to the outer surface or wall of the cylinder. The welds attaching the cylinder and casing side wall tend to distort the side wall so that, rather than being a truly cylindrical shape, in the vicinity of the welds, the side wall extends in a generally straight line or plane between adjacent welds. This brings the side wall intermediate adjacent welds into contact with the cylinder outer wall. It is believed that such intermediate contact contributes greatly to the noise emission.

SUMMARY OF THE INVENTION

It is a general object of the present invention to provide a rotary compressor mechanism in which noise emission is effectively limited.

It is another object of the present invention to provide such a compressor mechanism in which conduction of noise from the cylinder to the casing is minimized.

It is yet another object of the present invention to provide such a compressor mechanism in which means is provided to assure that unwanted contact between the cylinder and casing side wall is precluded.

It is still a further object of the present invention to provide such a compressor mechanism including means for stiffening the casing side wall in the vicinity of the compressor cylinder.

In accordance with an illustrated embodiment of the invention there is provided a compressor unit including a hermetically sealed casing having a side wall with a cylindrical inner surface. An electric motor is positioned in the casing and includes a stator with a cylindrical outer wall having an interfering fit with the side wall inner surface. A rotary compressor, positioned in the casing and driven by the motor, includes a cylinder having an outer wall welded to the casing side wall. At least one stiffening ring is positioned adjacent to the cylinder and includes a cylindrical outer wall of larger diameter than the cylinder outer wall and having an interfering fit with the side wall inner surface.

In accordance with an illustrated method of assembly the motor stator, cylinder and stiffening ring are supported in axial alignment, with the stiffening ring positioned adjacent to the cylinder. The casing side wall is heated until it expands sufficiently to fit around the stator and stiffening ring and then is placed over the stator, cylinder and ring. The casing side wall is cooled and contracts into a tight interfering relationship with the stator and stiffening ring. Then the cylinder is welded to the casing side wall at selected positions.

We have found that external stiffening rings adjacent the area of cylinder casing attachment do not provide the kind of improvement provided by an internal ring structure. While not fully understood the reasons may include the fact that external rings add to the surface area which radiates noise and the fact that external rings follow distortion or movement of the casing without effectively restraining it.

DESCRIPTION OF THE PREFERRED EMBODIMENTS

The present invention relates to rotary compressors, particularly such compressors in which the cylinder of the compressor unit is attached to the wall of the hermetically sealed housing or casing to position the compressor unit within the casing. For ease of understanding the drawings of the present application are somewhat simplified and somewhat schematic in form. An example of a rotary compressor in which the present invention may advantageously be incorporated is shown and described in U.S. Pat. No. 4,664,608, assigned to General Electric Company, assignee of the present invention, which patent is herein incorporated by reference.

Figure 1:
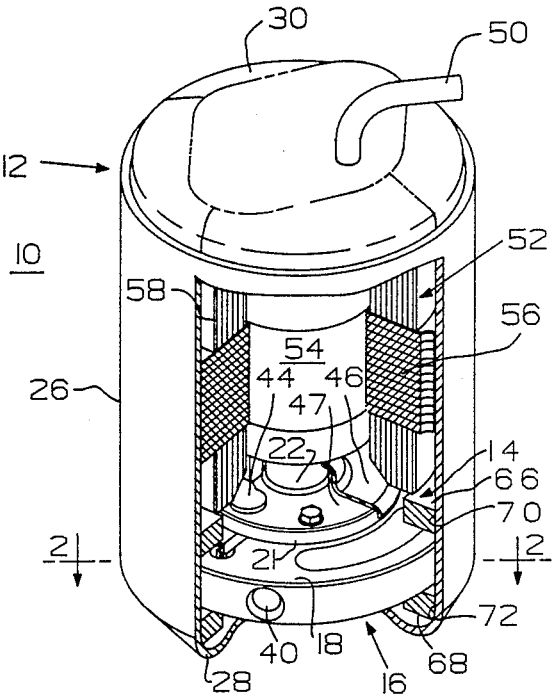
FIG. 1 is a side perspective view of a rotary compressor incorporating one embodiment of the present invention, the view being somewhat simplified and partially broken away for purposes of illustration.
Figure 2:
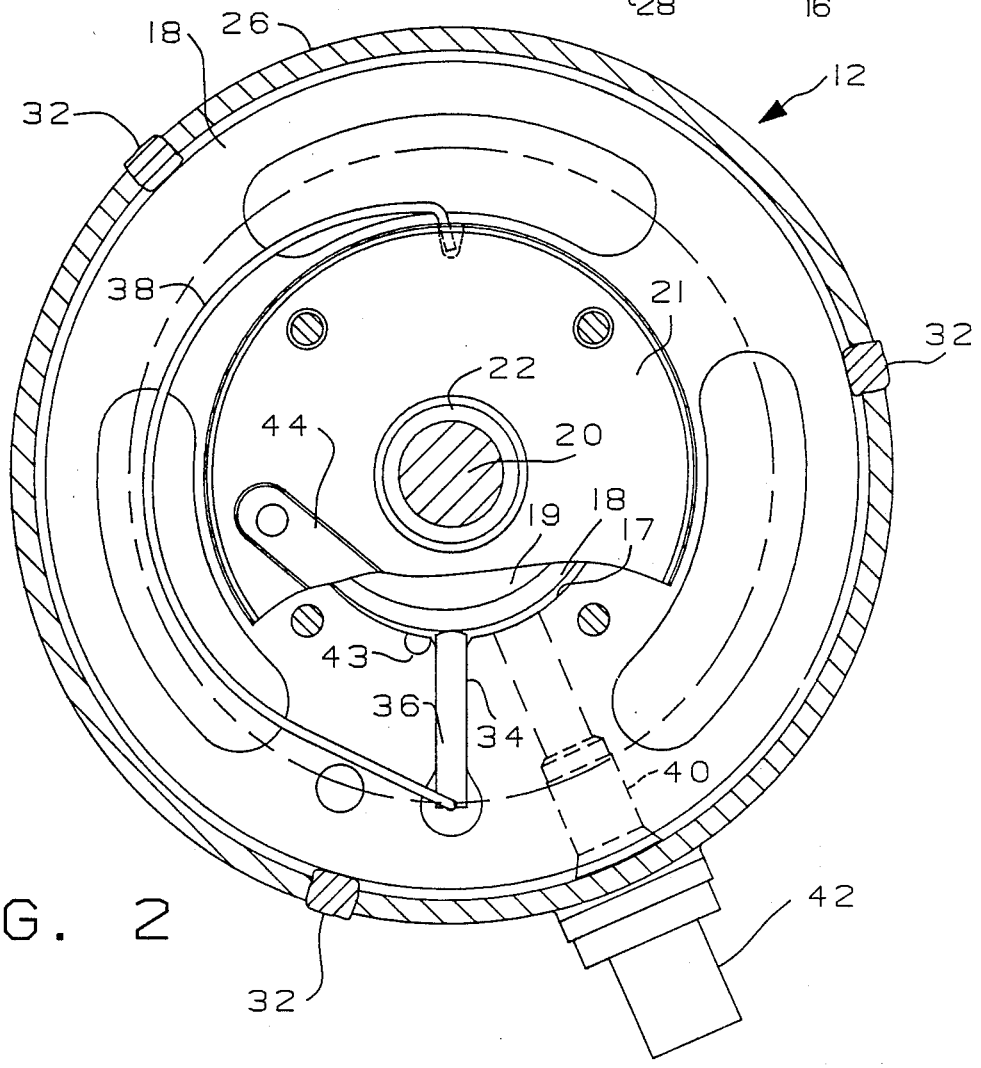
FIG. 2 is a cross-sectional view as seen generally along the line 2—2 in FIG. 1.

Referring now to FIGS. 1 and 2 of the drawings, there is shown a hermetic compressor 10 including a hermetically sealed casing 12 in which there is disposed a refrigerant compressor unit 14 having a cylinder 16. As is conventional with rotary compressors, a compression chamber 17 is formed within the cylinder 16 and a roller 18 is positioned within the chamber and is driven by an eccentric 19 formed as an integral part of the drive shaft 20. The top of the chamber 17 is closed by a main frame or upper end wall 21 which includes a hollow journal bearing 22 that supports the shaft 20. The opposite or lower end of the chamber is closed by a lower end wall 24 (see FIG. 3) which also supports the distal end of the shaft 20.

The casing 12 includes a side wall 26, a lower end wall 28 and a upper end wall 30. Conveniently the side wall 26 and lower end wall 28 may be formed from one piece of metal while the upper end wall 30 is formed separately and is attached to the side wall 26 by some convenient method such as welding after the operative components of the compressor have been assembled within the casing. However it will be understood hat other casing constructions are acceptable. For instance the side wall and each of the end walls may be formed separately and then attached to one another to provide a unitary hermetically sealed structure. The cylinder 16 is welded to the casing side wall 26 at selected positions around the circumference of the side wall to support the compressor unit 14 within the casing 12. For purposes of illustration three such welds 32 are shown; however, other numbers of spot wells may be used if desired. For example, four spot welds often are provided.

The cylinder 16 is provided with a radial vane slot 34 in which is slidably disposed a blade or vane 36. The vane 36 is biased by a spring 38 so that its radially inner end is in engagement with the peripheral surface of the roller 18 thereby dividing the chamber 17 into a low and a high pressure side. Means for delivering suction or low pressure gas into the low pressure side of the chamber 17 includes a channel or bore 40 which extends through the side of the cylinder 16 and communicates with the compression chamber 17. The outer end of the channel 40 is provided with a fitting 42 for connection to the end of the refrigerant system suction line.

As the drive shaft 20 rotates, the eccentric 19 and roller 18 are moved in a counterclockwise direction within the chamber 17 compressing the refrigerant gas within the chamber. A discharge port 43, formed in the cylinder 16 and the main frame or upper end wall 21, is closed by a valve 44. When the gas pressure within the high pressure side of chamber 17 builds to a sufficiently high level it causes the valve 44 to open and the gas in the high pressure side discharges into the hermetic casing 12. A cap 46 fits tightly around the peripheral edge of the upper end wall 21 and is spaced slightly from the journal bearing 22 to form a discharge chamber 47. Gas flowing by the valve 44 is first received in the discharge chamber, which acts as a muffler to reduce noise of the high pressure gas passing from the chamber 17 into the hermetically sealed casing 12. The gas passes from the discharge chamber 47 into the main portion of the compressor casing 12 through the space between bearing 22 and cap 46. High pressure gas discharges from the casing 12 to the refrigerant system through high pressure outlet pipe 50.

The compressor 10 also includes a motor 52 having a rotor 54 and a stator including a stator core 56 and windings 5E. Typically the inner surface 60 of the casing side wall 26, the outer surface 62 of the cylinder 16 and the outer surface 64 of the stator core 56 are all substantially cylindrical in shape. The diameter of the stator core outer surface 62 essentially matches the diameter of the inside surface 60 of the casing side wall 26 while the diameter of the cylinder outer surface 62 is somewhat smaller. Typically prior art compressors are assembled, in part, by heating the casing side wall so that it expands until the inner surface 60 is larger than the stator core outer surface 64, then inserting the casing side wall 26 about the stator core 56 and cylinder 16 and then cooling the casing side wall so as to obtain a tight interfering fit between the stator 56 and side wall 26. The smaller diameter cylinder 16 then is spaced from the side wall inside surface 60. The motor rotor 54 then is inserted into the stator about the shaft 20 and is connected to the shaft. This provides proper axial alignment of the components, after which the cylinder 16 is spot welded to the side wall 26 at a number of positions spaced apart around the circumference of the side wall.

In such prior art constructions the casing side wall 26 tends to deflect between weld points so that, intermediate the weld points, the casing comes into contact with the outer surface 62 of the cylinder 16. Such intermediate position contacts are not welded and vibrations of the cylinder 16 can cause the cylinder and casing side wall 26 to repeatedly hit against one another and generate noise which is radiated outwardly by the casing 12. Also noise generated within the cylinder can be transmitted to the casing through the cylinder to casing contacts.

In accordance with the present invention at least one stiffening ring is positioned within the casing 12 adjacent to the cylinder 16 and has a tight interfering fit with the casing side wall. Referring particularly to FIG. 1 there is shown a first ring 66 positioned adjacent the cylinder 16 between the cylinder and the motor stator 56 and a second ring 68 positioned adjacent the cylinder 16 on the side remote from the motor 52. The stiffening rings 66 and 68 have outer surfaces 70 and 72 respectively which are generally cylindrical in shape and are of substantially the same diameter as the stator core outer surface 64. In any event the rings 66 and 68 have an outer diameter slightly larger than the outer diameter of cylinder 16. When the casing side wall 26 is cooled and thus shrink fits tightly about the stator core 56 it also shrink fits tightly about the stiffening rings 66 and 68. The stiffening rings then serve two functions. First they stiffen or reinforce the casing side wall 26 so that it is less subject to vibration, even in response to energy imparted through the spot welds 32. Secondly the stiffening rings maintain the side wall 26 in a more nearly true cylindrical configuration so that it does not deflect and contact with cylinder 16 intermediate the spot welds.

The embodiment of FIG. 1 illustrates two stiffening rings 66 and 68, as that construction provides the greatest decrease of compressor noise emission suppression. However, one stiffening ring provides greatly enhanced operation. For ease of assembly, if it is chosen to have only one stiffening ring, ring 66 would normally be preferable.

Figure 3:
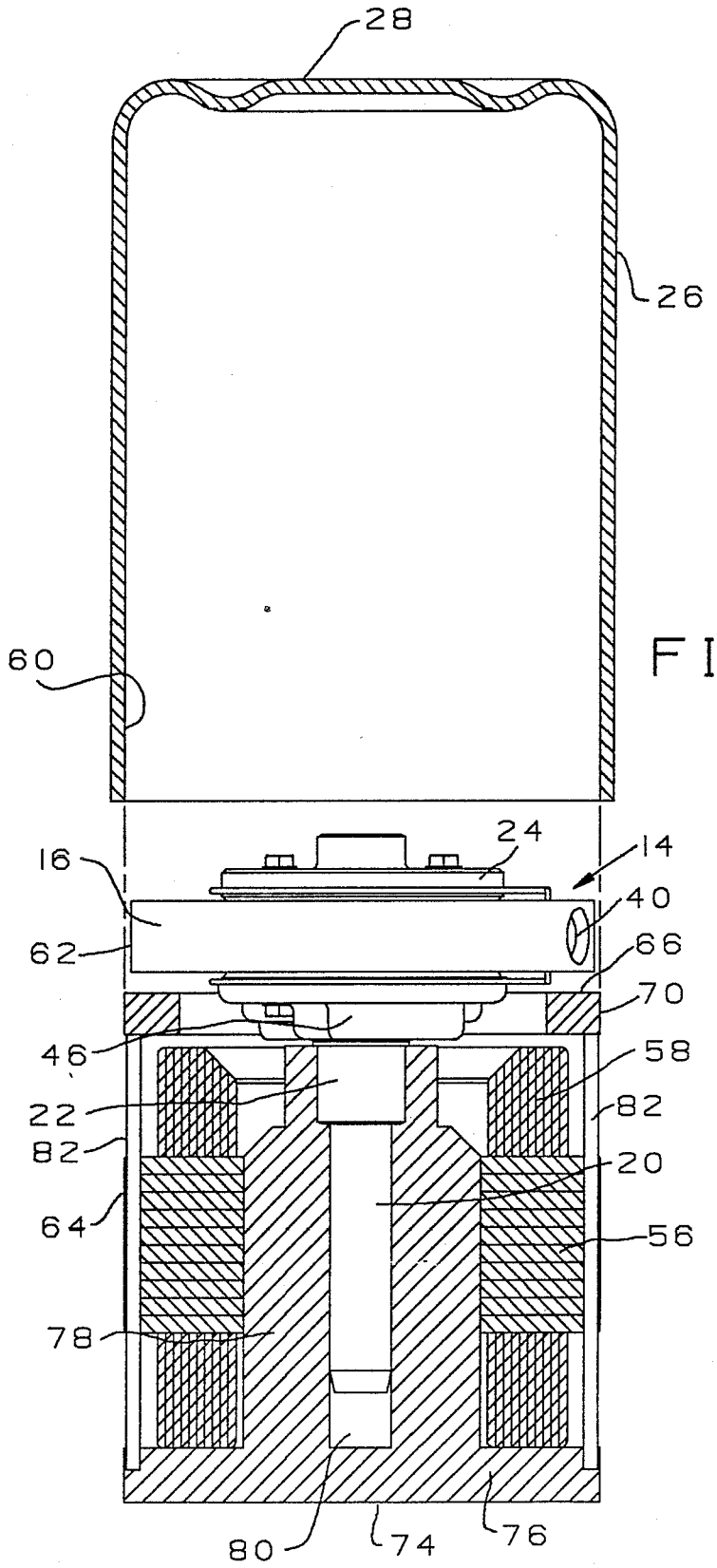
FIG. 3 is a side elevational view, partially in cross-section, illustrating an assembly of parts for a compressor being assembled in accordance with one aspect of the present invention.

Referring now to FIG. 3 there is shown the compressor in partly assembled configuration with a fixture which may be used in either a manual or an automated assembly operation. The fixture 74 includes a base 76 with a centrally positioned upwardly extending core 78 having a central bore 80 and peripherally arranged, upwardly extending fingers 82. The core 78 replaces the motor rotor 54 during the assembly operation step. The stator core 56 is inserted over the core 78 and fingers 82 with the fingers passing through small aligning openings near the peripheral edge of the stator core 56. The stiffening ring 66 is positioned on the distal ends of the fingers 82 and the ring 66 may be formed with small indentations to assure that the outer periphery of the ring 66 and of the stator core 56 are in alignment. The compressor unit 14 then is placed above the stiffening ring 66 with the shaft 20 and journal bearing 22 inserted in the bore 80. This properly positions the compressor unit 14 relative to the motor stator and assures that the outer periphery of the cylinder 16 is spaced inwardly of the outer periphery of the stiffening ring 60 and the stator core 56 entirely around their circumferences. Then the casing side wall 26 is heated so that its inner surface 60 becomes slightly larger than the outer surfaces of stiffening ring 66 and stator core 56 and the side wall is inserted about the compressor unit, stiffening ring and core and comes to rest on the base 76 of the fixture 74. The side wall 26 is then cooled and shrinks to form a tight interfering fit with the stiffening ring 66 and the stator core 56. Then the cylinder 16 and side wall 26 are joined by a selected number of spot welds spaced apart about the circumference of the cylinder 16 and side wall 26. Thereafter the assembly is removed from the fixture 74 and the construction of the compressor is completed by inserting the rotor 54 about the shaft 20 and connecting it thereto, as well as placing other operative components within the casing 12 and then attaching the casing upper end wall 30 to the side wall 26.

If its desired to include two stiffening rings the ring 68 may be assembled into the side wall 26 in the same basic manner as was described with regard to FIG. 3 by utilizing a slightly more complicated finger arrangement and slightly more complicated constructions for the ring 66 and perhaps the cylinder 16 so that a set of supporting fingers can extend to a point above the cylinder 16 (as seen in FIG. 3) and support the stiffening ring 68. The stiffening ring 68 also may be employed by utilizing a number of other construction methods. For instance it could be inserted into the casing 12 and secured to the side wall 26 adjacent the lower end wall 28 prior to the assembly step illustrated in FIG. 3. That method of assembly of ring 68 to side wall 26 could be accomplished by welding or by use of an appropriate adhesive capable of withstanding the temperature to which the side wall is subsequently heated. On the other hand the lower end wall 28 and the adjacent portion of the side wall 26 beyond cylinder 16 could be formed as a separate element and the stiffening ring 68 would be assembled into that separate element prior to its being connected to the main portion of the side wall 26 by some suitable means such as welding.

The use of one or more stiffening rings adjacent the cylinder and the method of assembly as set forth above have the added advantage of reducing distortion of vane slot 34.

The embodiments described heretofore are considered to be the presently preferred forms of the invention. However, in accordance with the patent statutes changes may be made in the disclosed apparatus and its manner of construction without actually departing from the true spirit and scope of the invention.

What is claimed is:

1. A hermetically sealed compressor unit including:

a hermetically sealed casing having a side wall with a cylindrical inner surface; an electric motor positioned within said casing and including a stator with a cylindrical outer wall having an interfering fit with said casing side wall inner surface;

a rotary compressor positioned within said casing to be driven by said motor, said compressor including a cylinder spaced from said motor and having a cylindrical outer wall; said cylinder outer wall being welded to said casing side wall at selected points spaced around said side wall; and at least one stiffening ring positioned adjacent said cylinder; said at least one ring including a cylindrical outer wall with a larger diameter than said cylinder outer wall and having an interfering fit with said casing side wall inner surface.

2. A compressor unit as set forth in claim 1 wherein said at least one ring includes a ring positioned between said motor stator and said cylinder.

3. A compressor unit as set forth in claim 1 wherein said at least one stiffening ring includes a ring positioned to the side of said cylinder remote from said motor stator.

4. A compressor as set forth in claim 1 wherein said at least one stiffening ring includes a first ring positioned between said motor stator and said cylinder and a second ring positioned to the side of said cylinder remote from said motor stator.

5. A compressor unit as set forth in claim 1 wherein said outer walls of said motor stator and said at least one stiffening ring are of substantially the same diameter and said casing side wall is heat shrunk into tight interfering fit with said outer walls of said stator and said at least one stiffening ring.

6. A method of assembling a compressor unit, including the steps of:

providing an electric motor having a stator with a cylindrical outer wall of a substantially predetermined diameter, a rotary compressor having a cylinder with a cylindrical outer wall of a diameter less than the predetermined diameter, a stiffening ring having a cylindrical outer wall of substantially the predetermined diameter, and a casing side wall having a cylindrical inner surface of a diameter to normally have a tight interfering fit with elements of substantially the predetermined outer diameter;

supporting the motor stator, cylinder and ring in axial alignment with the stator and cylinder axially separated and the ring positioned adjacent to the cylinder block;

heating the casing side wall to expand the diameter of its inner surface, positioning the casing side wall around the stator, cylinder and ring, and cooling the casing side wall so that it comes into tight interfering fit with the stator and ring; and welding the cylinder to the side wall at selected points spaced apart around the side wall.

* * * * *